United States Patent [19]

Lucas

[11] 4,202,241

[45] May 13, 1980

[54] DECORATIVE DRUMSTICK SYSTEM WITH DIFFERENT APPEARING INSERTS

[76] Inventor: Stephen J. Lucas, 2429 Frenchman St., New Orleans, La. 70119

[21] Appl. No.: 921,757

[22] Filed: Jul. 3, 1978

[51] Int. Cl.[2] ..... G10D 13/00

[52] U.S. Cl. ..... 84/422 S

[58] Field of Search ..... 84/422 R, 422 S, 477 B

[56] References Cited

U.S. PATENT DOCUMENTS

| | | | |
|---|---|---|---|
| 3,113,482 | 12/1963 | Hirsch | 84/477 B |
| 3,147,660 | 9/1964 | Brilhart | 84/422 S |
| 3,217,581 | 11/1965 | Hinger | 84/422 S |
| 3,435,723 | 4/1969 | Corder | 84/411 R |
| 3,585,897 | 6/1971 | Stalcup | 84/422 S |
| 3,722,350 | 3/1973 | Cordes | 84/422 S |
| 3,730,590 | 5/1973 | Brochstein | 84/422 S |

*Primary Examiner*—Lawrence R. Franklin
*Attorney, Agent, or Firm*—C. Emmett Pugh & Associates

[57] ABSTRACT

A drumstick structure provides a structural outer body, preferably transparent, with a central hollow bore therein, into which a rod can be inserted as desired. The central portion is permanent, or removable which can be interchanged between drumsticks as desired. In the preferred embodiment, the inner portion is comprised of an elongated shaft which conforms to the configuration of the inner bore. An end cap seals off the inner bore securing the rod therein by providing a screw-on end portion. In the preferred embodiment the cap can be an enlarged rubberized tip to provide a tympani beater head. In an alternative embodiment, the inner portion is injected with an injection moldable plastic, the plastic then hardened to form a permanent but lighter inner portion so as to make the overall drumstick a desired weight. The drumstick would be of a plastic construction to provide greater strength. In the preferred embodiment, the outer portion would be clear so that the inner portion would be visible to an observer through the outer clear structure. Thus, an individual could swap inner portions to provide a desired color as the individual may prefer. A gum rubber band can be placed on the outer surface of a portion of the drumstick as an aid to gripping and can also be permanent or removable. In another alternative embodiment, an end tip cap seals off the inner bore from the front securing the rod therein by providing a screw-on tip portion.

5 Claims, 10 Drawing Figures

DECORATIVE DRUMSTICK SYSTEM WITH DIFFERENT APPEARING INSERTS

BACKGROUND OF THE INVENTION

1. Field of the Invention

The present invention relates to musical instruments and more particularly to percussion type musical instruments. Even more particularly, the present invention relates to a drumstick wherein the outer structural portion of the drumstick wherein the outer structural portion of the drumstick is transparent and hollowed, providing an inner bore. The inner bore contains a separate innermost colored or light generating portion, the colored or light generating inner portion showing through the outer clear structural portion. The present invention includes interchangeable pieces; tips, butts, rubber jackets and inner portions.

2. Prior Art

In the musical industry, which caters to both large bands such as is associated with schools and the like, and smaller groups such as musicians forming rock groups or bands, there is a need for an economical, yet structurally sound drumstick which can be variously colored to fit the needs of the individual or needs of a specific concert use.

It is desirable that an individual could have one drumstick which would fit all of his needs and be adaptable to various situations which would prefer the use of a certain colored drumstick and the use of interchangeable pieces. For example, if an individual were a member of a high school band, he may desire drumsticks having his high school colors or need a different designed stick.

The same individual may be employed part-time or the like as a musician with a private band. In such a case, his high school colored drum sticks would not be suitable, but he may want a drumstick having a more flamboyant appearance, such as fluorescent, luminous or the like. Such may be the case where an individual were playing in a band which had appearances at night and a "glow-in the-dark" appearance would be desirable. A problem then arises where an individual is forced to purchase numerous drumsticks to match his desires as his musical situations change. His only recourse is to purchase a plurality of drumsticks to meet all these needs.

An additional problem with drumsticks, particularly those used with metal percussion instruments, is that of breakage. Drumsticks are generally manufactured of wood and have a tendency to become chipped when the musician inadvertently may strike the drum rim rather than the surface thereof. In such as case, the dents over a period of time multiply and the drumstick weakens and thereafter breaks.

A partial solution to the breakage has been provided with the use of plastic drumsticks which give a lighter brighter sound. Plastic drumsticks have been manufactured which provide greater strength in order to overcome the breakage problem.

A problem which exists with plastic drumsticks however, is the problem of weight. While plastic is stronger, it is heavier than the wood which is normally used in the manufacture of drumsticks. Thus, in some instances, the inner portion of the drumstick has been hollowed in order to lessen the weight and allow the drumstick to be the proper weight so as to be acceptable to the musician.

In U.S. Pat. No. 3,958,485 there is provided a plastic drumstick which has a hollow inner portion and provides necessary strength to the drumstick by means of a plurality of inner ribs. Thus, it can be seen that when a drumstick is hollowed, some sort of structural rib structure has been taught in order to stiffen the stick appreciably in order to give it the desired strength and still have the desirable weight characteristics.

The following table provides a listing of U.S. Patents which have been issued and provide drumstick structures:

| PRIOR ART PATENTS | | |
|---|---|---|
| U.S. PAT. NO. | INVENTOR(S) | ISSUE DATE |
| 3,147,660 | A. R. Brilhart | Sept. 8, 1964 |
| 3,165,964 | H. R. Stys et al | Jan. 19, 1965 |
| 3,420,134 | C. P. Cordes | Jan. 7, 1969 |
| 3,489,052 | D. B. Colyer, et al | Jan. 13, 1970 |
| 3,958,485 | T. O. Peters | May 25, 1976 |

In many of the prior art devices, the breakage problem has only been partially solved. In the U.S. Pat. No. 3,958,485, a plurality of ribs is provided to a substantially hollow drumstick. Though strength may be increased over a wooden stick by using ribs, a problem which, occurs with these drumsticks is that the drumstick shatters and pieces are thrown into many directions creating a hazard.

3. General Discussion of the Present Invention

The present invention provides a plastic drumstick which has both improved structural and sound characteristics as well as providing a means for varying the color and design of the drumsticks themselves to meet individual situations.

The present invention provides a substantially hollow inner portion to an outer structural plastic drumstick, the inner portion providing a bore into which a lighter weight material can be inserted. The outer core is preferably transparent, with the inner core portion having colors as desired. Thus, the inner portion can be colored any number of colors to match high school colors, band colors, or to give desired luminous or fluorescent effects. For groups which play at night, there can be provided then inner portions which are luminous so as to glow-in-the-dark, giving especially desirable effects to rock-bands whose followers demand such flamboyance.

In an alternative embodiment, the inner bore can be injected with an injection moldable plastic or like material of a lighter weight which can be pliable and adhere to the inner bore, additionally being colored to produce the desired color which would be visible through the transparent outer core. Such an injectionable moldable plastic would adhere to the outer core and thus prevent the hazard of flying parts if a fracture of the drumstick would occur. In the event of breakage, the outer structural parts would adhere to the inner pliable plastic portion and thus be prevented from shattering.

In another alternative embodiment the drumstick has an inner bore which extends throughout from tip to butt. The tip is tapered to allow an opening as large as possible without interferring with the performance of the drumstick. As above, the core may be provided with a colored or luminous film, which may be a strengthening adhesive type to allow for a further reduction in weight. The open bore completely throughout allows an air current to flow therethrough. Thus the drumstick has less air friction resistance to the back and forth motions of drumming. The stick falls downward faster and responds upward faster. In addition, the drumstick vibrates and sounds differently with respect to other configurations.

In summary, the present invention is safer, has greater durability, enhanced decorative effects with greater visibility, and is relatively inexpensive due to less breakage and more abundance of plastic than wood.

In the preferred embodiment of the present invention, the drumstick is made from "LEXAN" plastic and is believed to be the safest drumstick made. It produces a different sounding drumstick when selected pieces are interchanged and is most responsive when struck on any percussion instrument. The material is transparent, lightweight and very strong.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein;

FIG. 8 is a partial perspective, exploded view of a third alternative embodiment, illustrating the connection and interchangeability of a tip cap for the drumstick body.

DETAILED DESCRIPTION OF THE PREFERRED EMBODIMENT

Figure 1:
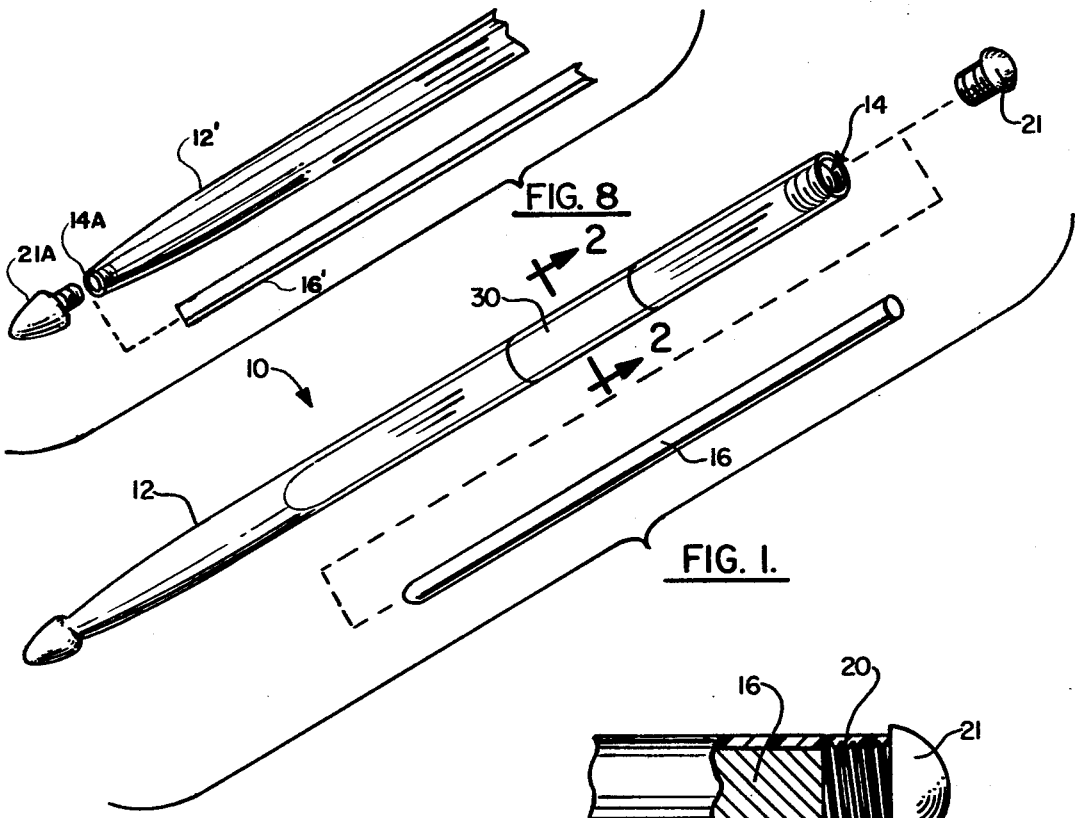
FIG. 1 is a perspective exploded view of the preferred embodiment of the apparatus of the present invention.
Figure 3:
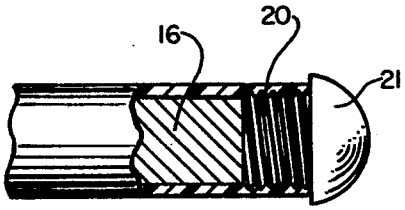
FIG. 3 is a partial, side view, partially in cross-section, illustrating the connection of the cap to the drumstick body.

As can best be seen in FIG. 1, the preferred embodiment of the apparatus of the present invention designated generally by the numeral 10 in FIG. 1, is comprised of an outer body 12 having an inner bore 14 into which an inner core 16 is insertable. The bore 14 provided within outer body 12 is so sized as to allow the fitment of core material 16 therein so as to form a substantially close fit.

Cap 21 is insertable into the opening 14 at threaded connection 20. Cap 21 would normally be provided with threaded or like connections so as to make a tight fit to bore 14 at connection 20.

Figure 5:
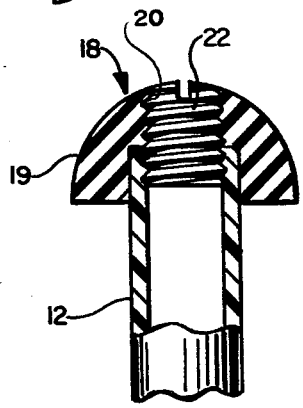
FIG. 5 is a partial, side view, partially in cross-section, of a second alternative embodiment of the Tympani beater head portion of the present invention.

In an alternative embodiment as shown in FIG. 5, a Tympani beater head 18 is provided with a threaded connector 22 which threadably connects 18 to body 12 and thread connection 20. The attachment of head 18 to body 12 forms a tight connection which forces core 16 into a substantially tight immovable position within bore 14 when the threaded connection 20 is complete. Thus the entire drumstick 10 would be substantially a tight single unit when the connection of head 18 to body 12 were completed with core 16 within bore 14. The fit would be preferably so tight and immovable that the entire drumstick 10 would perform with substantially the same performance of a standard one piece integral drumstick.

In the preferred embodiment, outer body 12 would be transparent and be manufactured of a suitable plastic material which would be resilient enough to withstand the punishment to which a drumstick is normally subjected. An exemplary material for the manufacture of outer body 12 would be a plastic such as the polycarbonate manufactured under the trademark "LEXAN" as manufactured by General Electric.

Inner core 16 could normally be any number of desireable colors which would be visible through transparent body 12, thus allowing the drumstick to have a plurality of desireable colors as well as tints, or fluorescence or the like which would permit core 16 to "glow-in-the-dark" as is known in the plastic art. Thus the drumstick would appear normally an opaque drumstick with a high gloss appearance, or if a fluorescent material was used for core 16, it may appear dull in daylight yet glow brightly when used with appropriate lighting at night.

Tympani beater 18 could be manufactured of any suitable hard material such as hardened rubber. Tympani beater head would be comprised of beater head 19 and connector 22. These two parts could be easily joined as is known in the art or cast as a single integral part. In the preferred embodiment, shown in FIG. 5, threaded connector 22 would be of a suitable harder plastic material such as polycarbonate and thus be suitable as a threaded connector, which material may not be suitable as a material for tympani head 19 itself. Thus the head portion 19 would be of a suitable pliable rubber material such as hardened rubber. A specific material could be the rubberized material as is found in the "superball" as manufactured by "WHAMO".

Tympani head 18 could be decoratively coated with any type surface as is desired. Exemplary covering for tympani head 18 could be permanent affixed to the drumstick body 12 if the interchangeability of inner cores 16 is not desireable by a structure such as for example as shown in the alternative embodiment in FIG. 7.

Figure 4:
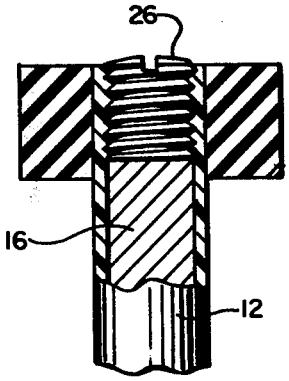
FIG. 4 is a partial, side view, partially in cross-section, of a first alternative embodiment of the Tympani beater head portion of the present invention.
Figure 6:
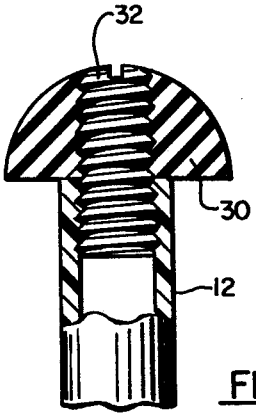
FIGS. 6 and 7 are partial, side views, partially in cross-section of two other versions of the second embodiment of the Tympani beater head portion of the present invention showing alternative attachment structures

Other alternative embodiments for the tympani head are shown in FIGS. 4 and 6, in which in the former a separate cap screw 26 holds in the rod 16 while the tympani head 25 is secured to the body 12 by adhesive; while in the latter the connector 32 is longer than that of connector 22, giving a greater surface area to which the head 30 can be secured.

Figure 2:
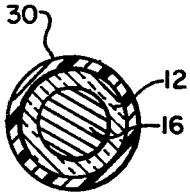
FIG. 2 is a sectional view taken along lines 2—2 of FIG. 1.

As can best be seen in FIGS. 1 and 2, drumstick 10 could be provided with any desired gripping surface 30 in proximity to the portion of the stick normally gripped by the musician. In FIGS. 1 and 2, the gripping surface could be for example a gum rubber or like non-slip material. Furthermore, the gum rubber piece for gripping surface 30 may be removeable and attachable to the drumstick 10 as desired by means of it being elastic so as to fit this piece starting from the drumstick tip and then rolling to and fitting it to its desired position. When so fitted it would be sufficiently stuck to the drumstick to prevent its unintentional movement.

In a further alternative embodiment as shown in FIG. 8, a drumstick tip 21A is provided with a threaded portion which threadabily connects tip 21A to body 12 which is likewise threaded. The attachment of head 21A to body 12 forms a tight connection which forces core 16 into a substantially tight immovable position within base 14 A when the threaded connection is complete. (Also, cap 21 or alternatively cap 21A could be unitized to core 16 fitting within bore 14.) The fit would be preferably so tight and immovable that the entire drumstick 10 would perform with substantially the same performance of a standard one piece integral drumstick.

The construction of the preferred embodiment of the drumstick 10 of the present invention, as shown in FIGS. 1 and 2, provides a means for varying the weight of the drumstick itself, while allowing the outermost core 12 to be of a strong heavier, resilient plastic while the inner core can be of a lighter colored material, lending structural support to the overall drumstick. Thus the combination of outer body 12 and inner core 16 provides a proper weighted drumstick, yet a resilient drumstick which can withstand the forces normally experienced by the musician.

Outer core 12 can be of substantially hard impact resistant material. In the preferred embodiment, this outer material would be transparent allowing the innermost core portion to be readily visible therethrough.

The inner core would be a less impact resistant material of a lighter weight than outer core 12, thus allowing the overall weight of the drumstick to be proper.

The outermost core could be of any highly resilient clear plastic in the transparent embodiment. Such a material would be the polycarbonate sold under the brand name "LEXAN" as manufactured by General Electric.

This material could also be used for threaded connector 22 of tympani head 18.

The inner core could be any supportive but less resilient plastic of lighter weight so as to provide an overall drumstick of the proper weight. Exemplary materials for inner core 16 would be polyprophylene, polyethalene, and the like Indeed it is conceivable that the material for filling bore could be a luminous, colored liquid, but such it is believed is not as perferred as an at least generally rigid rod. Additionally, the insert could have electrical light generating means includable within it or as part of the insert. Also, although having the bore completely filled by the inner material is highly desirable and preferred, it is conceivable that some advantages of the present invention could be had without the bore being completely filled or even with a drumstick in which a further, inner bore is included and left open throughout the length of the stick.

FIG. 4 illustrates an alternative embodiment to the tympani beater head portion of the present invention. In FIG. 4 there is attached to drumstick body 12 the tympani head 25 which is integrally bound thereto. The attachment of tympani head 25 to drumstick 12 in FIG. 4 is substantially permanent, it being bonded to the drumstick 12 with glue or like adhesive. A threaded cap 26 seals the inner bore 14 of the drumstick and forces inner core 16 into a tight substantially rigid fit therewithin.

FIG. 6 illustrates another embodiment of the tympani body head portion of the drumstick 10 of the present invention. In FIG. 6, the tympani head 30 is provided with a mounting screw 32 which is integrally formed therewith. The mounting screw 32 can be a harder more resilient material capable of threadably and structurally catching the tympani beater head 30 to drumstick 12.

Figure 7:
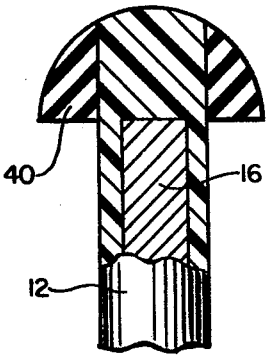

FIG. 7 shows a further embodiment of the tympani head 40 portion of the drumstick 12. In FIG. 7, the tympani head is permanently bound to the drumstick body 12 by means of a suitable adhesive such as glue or the like. In the embodiment shown in FIG. 7, the inner bore 16 of drumstick 12 is comprised of a material which can be injected into the drumstick through a port or like opening which is thereafter sealed. Thus, a threadable cap such as is shown in FIGS. 1 through 6 is not necessary. Thus the tympani head member 40 is added by bonding it to the stick 12 by means of glue or like adhesive.

Figure 9:
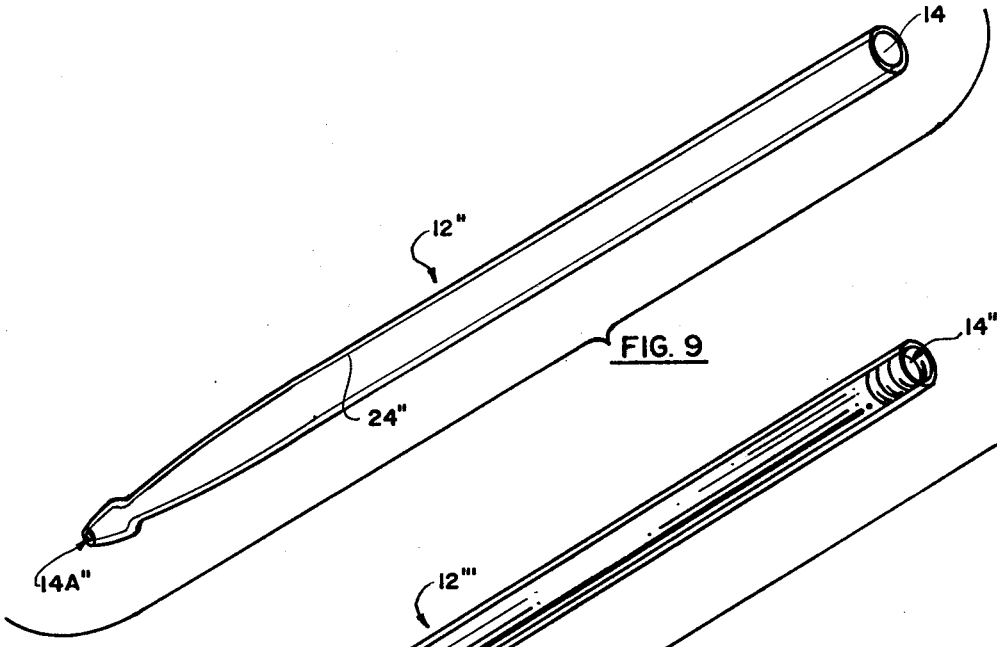
FIG. 9 is a perspective view of a fourth alternative embodiment which is hollow throughout.

FIG. 9 shows another embodiment of the present invention which is hollow throughout. As shown, drumstick body 12" is provided with a lengthwise inner bore 14 from end to tip 14A. Tip 14A is tapered for proper performance while allowing an opening as large as possible while permitting the tip wall to have sufficient thickness for appropriate strength. Bore 14 may also receive a coating, such as an adhesive, which may be colored or luminous to provide added strength and attractiveness.

Figure 10:
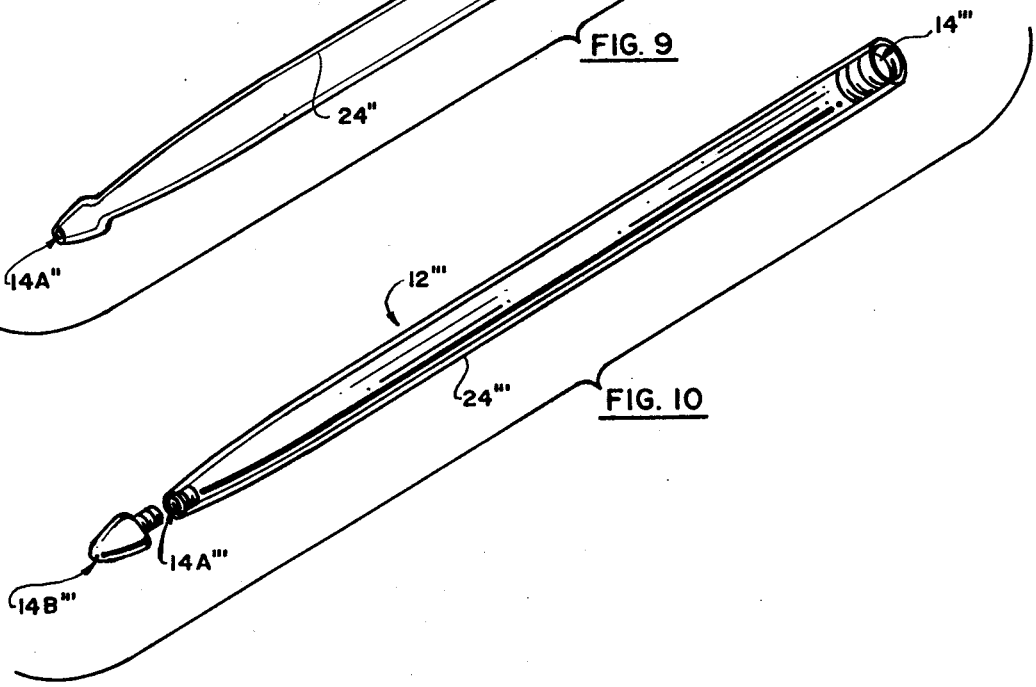
FIG. 10 is an exploded perspective view of a fifth alternative embodiment having interchangeable cap and tip.

FIG. 10 shows still another embodiment. Drumstick body 12" is provided with threading at either end of inner bore 14" to allow interchangeable tips 14B" and caps (not shown). Tips 14B" may be hollow throughout and caps may be any of the aforementioned caps or beaters.

Because many varying and different embodiment may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed as invention is:

1. A decorative drumstick system comprising: a. an outer, elongate drumstick body, at least in part, of transparent material and of a length and diameter to be held and controlled by and within a single human hand for controlled striking of, for example, a drum and other percussion sound instruments, said body being provided with an inner, cylindrical, elongated, longitudinal bore, under and visible through said transparent material said bore being of an at least similar diameter throughout, said bore being provided with an opening at at least one end portion, said opening being provided with a plurality of threads;

b. a number of different inner insert members each of substantially the same size as said bore but being of different decorative external appearance, each of said members being slidably and removably receivable on an individual basis into and from said bore, each of said members making a substantially close, tight, immovable fit with said bore when fully inserted and the open end closed off thereinto; and c. a head removably connectable to the open end portion of said bore at said threads, said head being provided with a plurality of threads which register with and threadably connect said head to said drumstick body of said bore to close off the end of said bore, said head tightly retaining the selected, inserted one of said insert members within said bore when said head is tightly connected to said body at said threads; said drumstick body being substantially transparent, around at least a substantial portion of said bore, and said inner, selected inserted member being colored, said insert member being visible through said outer drumstick body when said insert member has been fully placed within said drumstick body; the same drumstick body being usable to give off different decorative appearances by inserting a selected one of said different insert members as desired and allowing for later changing by substituting a different one of said different insert members into said bore of said drumstick body.

2. The drumstick system of claim 1, wherein said outer body is further provided with a gripping surface of non-slip material.

3. The drumstick system of claim 1, wherein the other end portion of said drumstick body is also threadably connected to the remainder of said drumstick body.

4. The drumstick system of claim 1, wherein said head is an enlarged head providing a tympani beater head to said drumstick body.

5. The drumstick system of claim 1 wherein at least one of said inner members gives off light by being colored, luminous or reflective.

* * * * *